US007611143B2

(12) United States Patent
Walsh et al.

(10) Patent No.: US 7,611,143 B2
(45) Date of Patent: Nov. 3, 2009

(54) SHEET SEPARATING APPARATUS AND METHOD

(75) Inventors: Martin R. Walsh, St. Albans (GB); Adrian Purnell, Kingswood (GB)

(73) Assignee: Xerox Corporation, Norwalk, CT (US)

( * ) Notice: Subject to any disclaimer, the term of this patent is extended or adjusted under 35 U.S.C. 154(b) by 170 days.

(21) Appl. No.: 11/894,385

(22) Filed: Aug. 21, 2007

(65) Prior Publication Data

US 2009/0051105 A1 Feb. 26, 2009

(51) Int. Cl.
*B65H 5/34* (2006.01)

(52) U.S. Cl. ..... 271/265.02; 271/270

(58) Field of Classification Search ..... 271/264, 271/265.01, 265.02, 266, 270, 10.03
See application file for complete search history.

(56) References Cited

U.S. PATENT DOCUMENTS 6,554,275 B1 * 4/2003 Tranquilla ..... 271/259
6,644,660 B2 * 11/2003 Sussmeier et al. ..... 271/270
6,836,640 B2 * 12/2004 Isemura et al. ..... 399/388
7,068,969 B2 * 6/2006 Ueda ..... 399/388
7,150,455 B2 * 12/2006 Furukawa et al. ..... 271/270
7,293,769 B2 * 11/2007 Asari et al. ..... 271/258.01
7,308,853 B2 * 12/2007 Satoh et al. ..... 101/118
7,396,175 B2 * 7/2008 Ueda ..... 400/708
7,448,622 B2 * 11/2008 Kim ..... 271/265.01
2005/0017442 A1 * 1/2005 Furukawa et al. ..... 271/270
2007/0045936 A1 3/2007 Kuo et al.

* cited by examiner

*Primary Examiner*—Kaitlin S Joerger
(74) *Attorney, Agent, or Firm*—Fay Sharpe LLP; Karl W. Hauber

(57) ABSTRACT

A sheet separating mechanism and a method of separating sheets is provided to prevent the multifeeding of sheets into printers or copiers. The sheet separating mechanism provides a first nip and a second nip for feeding a series of sheets therebetween. The first nip can include a first motor and the second nip can include a second motor for feeding a leading sheet from the first nip to the second nip. The mechanism further provides a first sensor for sensing a trailing edge of the leading sheet and a second sensor for sensing a leading edge of the leading sheet. The first sensor is upstream of the first motor and the second sensor is downstream of the second motor. A trailing sheet can be prevented from feeding with the leading sheet by stopping the first motor when the leading edge of the leading sheet is sensed by the second sensor while simultaneously the first sensor remains occluded.

21 Claims, 3 Drawing Sheets

SHEET SEPARATING APPARATUS AND METHOD

BACKGROUND

This disclosure is related to the feeding of media sheets in a printer or copier and more particularly to detecting and preventing multifeeds of sheets.

Multifeeds of media sheets in a printer or copier can be typically caused by welding of sheet edges, porosity of sheets, adhesion and static charge between sheets, as well as separate sheets being fed from multiple feed trays. A vacuum sheet feeding system can reduce some but not all multifeeds of sheets. When multifeeds do occur, the multiple sheets can jam the printer or copier forcing an operator to fix the jam, intervene with the print job, and possibly even damaging the printer or copier.

Quite often the multifeed will manifest itself as a "shingle" multifeed. In this case, the multifed sheets are not exactly overlapped and will have an offset. Due to the overlap, it is possible to separate the sheets by holding the trailing sheet in the previous set of nips and allowing the leading sheet to be taken away.

The present disclosure provides for an apparatus and method to detect and separate shingle sheets and thereby reduce multifeed/jam rates.

SUMMARY OF THE DISCLOSURE

In one arrangement, a sheet separating mechanism is provided to prevent the multifeeding of sheets into printers or copiers. The sheet separating mechanism provides a first nip and a second nip for feeding a series of sheets therebetween. The first nip can include a first motor and the second nip can include a second motor for feeding a leading sheet from the first nip to the second nip. The mechanism further provides a first sensor for sensing a trailing edge of the leading sheet and a second sensor for sensing a leading edge of the leading sheet. The first sensor is upstream of the first motor and the second sensor is downstream of the second motor. A trailing sheet can be prevented from feeding with the leading sheet by stopping the first motor when the leading edge of the leading sheet is sensed by the second sensor and when the first sensor remains occluded.

In another arrangement, a xerographic system is provided to prevent multifeeding of sheets. The system provides a sheet feeding apparatus having a first nip and a first sensor upstream from a second nip and a second sensor. The system further provides that the first nip includes a feed motion adapted to feed a pair of sheets in a feed direction from the first nip toward the second nip during the feed motion. The second nip includes a feed motion adapted to feed a leading sheet from the pair of sheets in the feed direction. The first nip is adapted to halt the feed motion responsive to the first and second sensors wherein a trailing sheet is stopped at a wait point positioned between the first nip and the second nip until the leading sheet clears the second sensor.

The disclosure further provides a method of feeding sheets to a printer or a copier comprising applying a feed force in a feed direction to a leading sheet. The feeding of the leading sheet can be from a first nip to a second nip wherein the first nip includes a first motor and the second nip includes a second motor. The first sensor can sense a trailing edge of the leading sheet and the second sensor can sense a leading edge of the leading sheet wherein the first sensor is upstream of the first motor and the second sensor is downstream of the second motor. The method prevents a trailing sheet from feeding with the leading sheet by stopping the first motor when the leading edge of the leading sheet is sensed by the second sensor while simultaneously the first sensor remains occluded.

DETAILED DESCRIPTION

Figure 1:
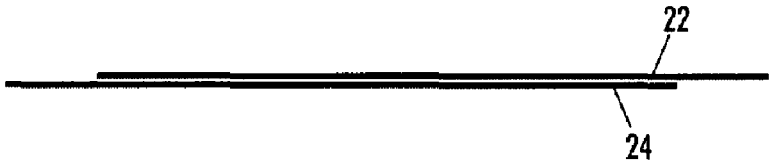
FIG. 1 is a side elevation view of a pair of shingled sheets, in one exemplary arrangement.
Figure 2:
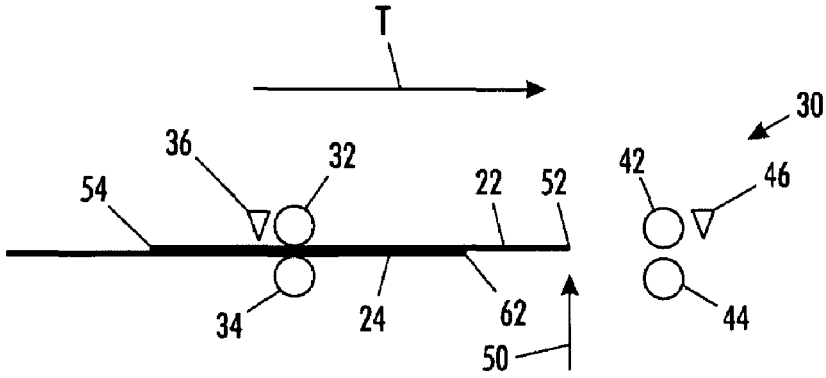
FIG. 2 is a side elevation view of a sheet feeding system including a sheet separating mechanism with the shingled sheets engaged with a first nip.

FIGS. 1 and 2 show a side elevation view of a pair of shingled sheets, in one exemplary arrangement, and a sheet feeding system, respectively. The sheet feeding system displays a pair of sheets 22, 24 being fed through the system to a printer or copier (not shown). In particular, the pair of sheets 22, 24 are being inadvertently fed through the system in a shingled multifeed fashion. If the shingled sheets advance through the system in this fashion, a jam will result. The cause of the shingled multifed sheets can be any number of reasons including, but not limited to, the following; welding of sheet edges, porosity of sheets, adhesion, static charge between sheets, and sheets being fed from multiple feeder trays.

An apparatus and method for detecting and separating shingled sheets is shown in FIG. 2-6 and will be described hereinafter. The sheet feeding system 30 of the present disclosure enables post feeder separation of media sheets. The system 30 includes a first nip 32 along with an associated first motor 34 and first sensor 36. The system 30 further includes a second nip 42 along with an associated second motor 44 and second sensor 46. The second nip 42 is downstream from the first nip 32 relative to the direction of media travel T, i.e. paper path movement.

Shingled sheets 22, 24 can be fed via the first motor 34 to a wait point or position 50 with the leading sheet 22 slightly ahead of, in front of, or offset from a trailing sheet 24. The offset shingled sheets 22, 24 can move together from the first nip 32 towards the second nip 42. The leading sheet 22 will reach the second nip 42 first. A leading edge 52 of the leading sheet 22 arrives at the second sensor 46 (refer to FIGS. 3 and 4). If the first sensor 36 does not sense a 'clear' signal, i.e. void of media, then the first motor 34 can be stopped. The leading sheet 22 can then be pulled from the first nip 32 and advanced through the second nip 42 via the second motor 44. The leading sheet 22 continues through the second nip 42 until the second sensor 46 'goes clear' (not occluded).

If the second sensor 46 goes clear at the expected time, then the trailing sheet 24 is determined to be a shingled sheet occluding the first sensor 36. The trailing sheet 24 can then be fed through the system 30 as the next top sheet thereby eliminating a jam situation and likely shutdown/intervention to the system 30.

In one exemplary arrangement, a xerographic system can comprise the sheet feeding apparatus having the first nip 32 and its associated first sensor 36 upstream from the second nip 42 and its associated second sensor 46. The first nip 32 can have a feed motion adapted to feed a pair of sheets 22, 24 in a feed direction from the first nip 32 toward the second nip 42 during the feed motion. The second nip 42 can have a feed motion adapted to feed the leading sheet 22 from the pair of sheets in the feed direction. The first nip 32 can be adapted to halt the feed motion in response to the first and second sensors 36, 46 wherein the trailing sheet 24 is stopped at the wait point 50, which can be positioned between the first nip 32 and the second nip 42, until the leading sheet 22 clears the second sensor 46.

The pair of sheets 22, 24 can each be of a predetermined length. The system 30 can further include a timer for timing the duration of time between entry of the leading edge 52 and exit of a trailing edge 54 of the leading sheet 22 with the second sensor 46. The duration of time can be compared with a predetermined time based upon the predetermined sheet length. The trailing sheet 24 can become a next leading sheet and the first motor 34 can feed the trailing sheet 24 from the first nip 32 to the second nip 42 when the duration is substantially equal to the predetermined time.

The first nip 32 and the second nip 42 can have a fixed spacing therebetween. The leading edge 62 of the trailing sheet is stopped at the wait point 50 when the first motor 34 is stopped. It is to be appreciated that the leading edge 52 of the leading sheet 22 is offset and downstream from the leading edge 62 of the trailing sheet 24.

Figure 3:
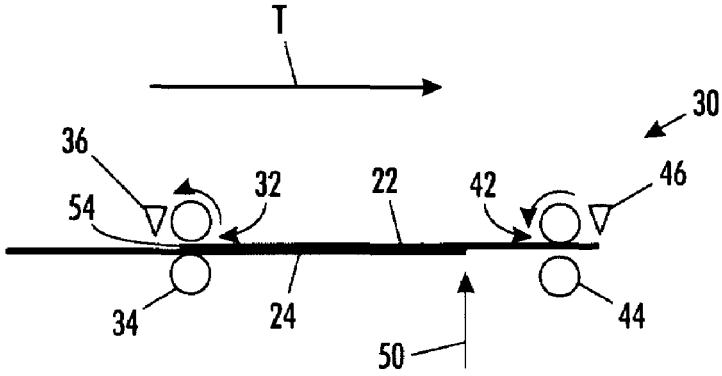
FIG. 3 is a side elevation view of a sheet feeding system including a sheet separating mechanism with a leading sheet engaged with a second nip.
Figure 4:
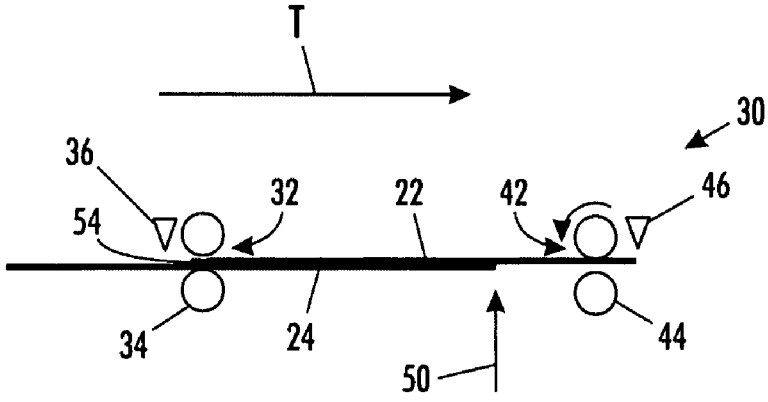
FIG. 4 is side elevation depiction of the sheet feeding system of FIG. 2 showing a sheet separating mechanism drive configuration.
Figure 5:
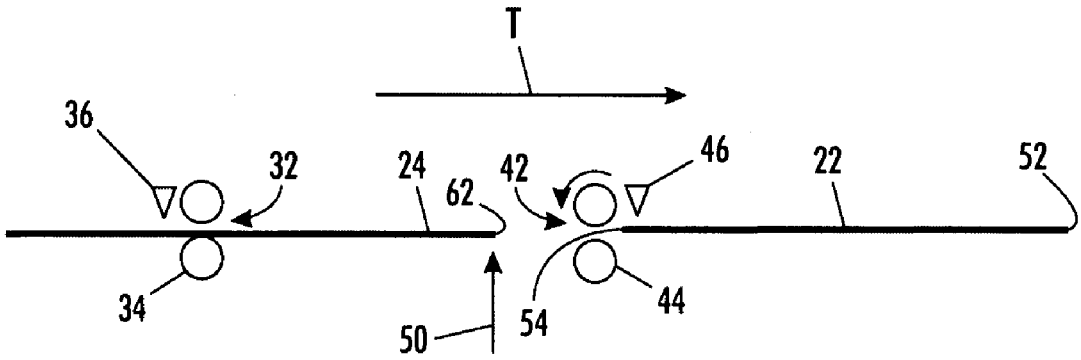
FIG. 5 is side elevation depiction of the sheet feeding system of FIG. 2 showing a sheet separating mechanism drive configuration with the shingled sheets separated; and, FIG. 6 is a flow chart depicting the disclosed method for detecting and separating multifed sheets.
Figure 6:
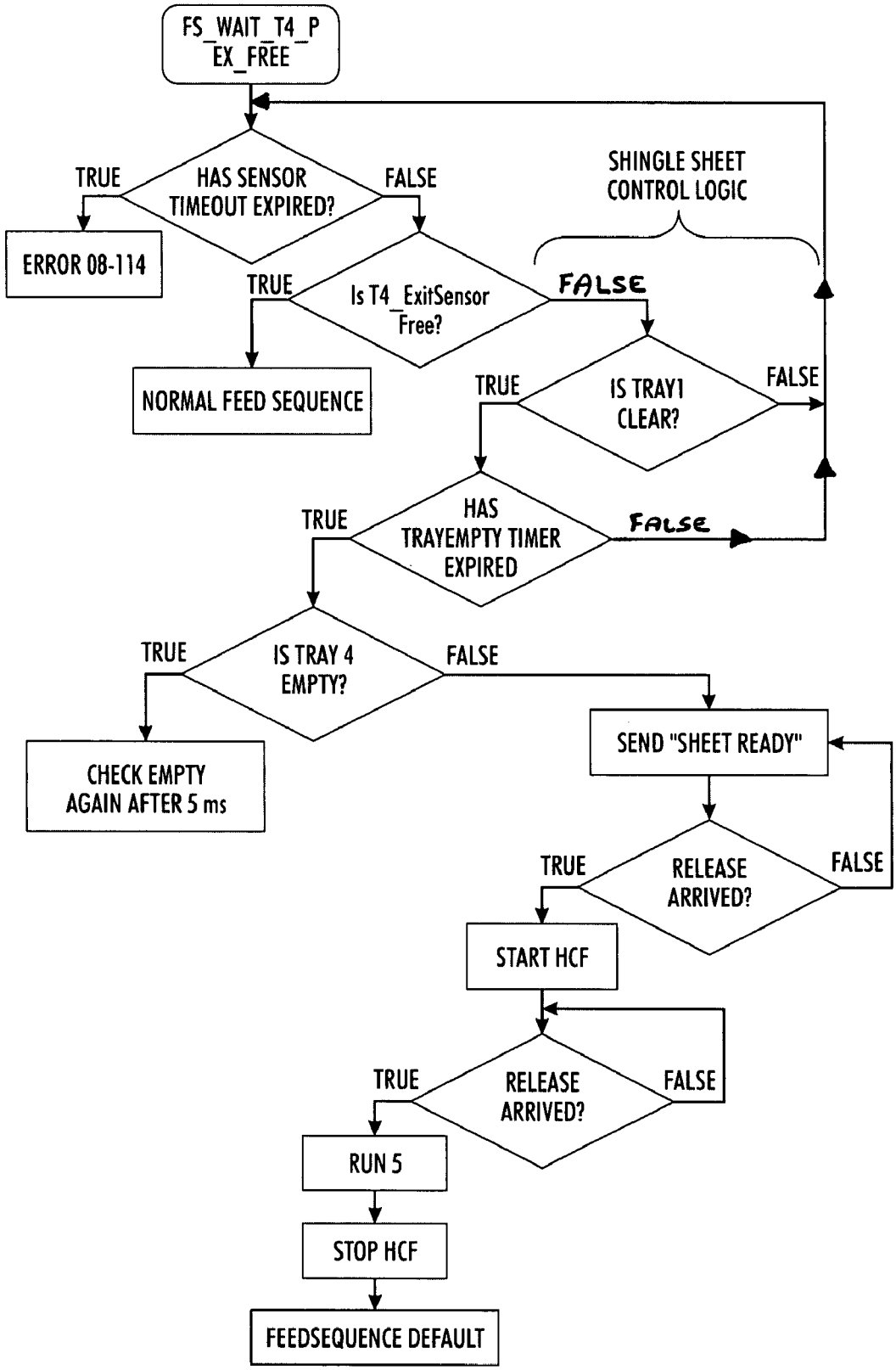

One exemplary method adapted for feeding sheets to a printer or a copier can be described as follows. Apply a feed force in a feed direction to the leading sheet 22. Feed the leading sheet 22 from the first nip 32 to the second nip 42 wherein the first nip 32 includes the first motor 34 and the second nip 42 includes the second motor 44. Sense the trailing edge 54 of the leading sheet 22 with the first sensor 36 and sense the leading edge 52 of the leading sheet 22 with the second sensor 46 wherein the first sensor 36 is upstream of the first motor 34 and the second sensor 46 is downstream of the second motor 44. The system 30 can prevent the trailing sheet 24 from feeding with the leading sheet 22 by stopping the first motor 34 when the leading edge 52 of the leading sheet 22 is sensed by the second sensor 46 while simultaneously the first sensor 36 remains occluded. Referring to FIGS. 3-5, it is to be appreciated that the first sensor 36 is being occluded by the trailing sheet 24.

If the sheets have a predetermined length and the nips have a fixed distance therebetween, then a predetermined duration is known for feeding a sheet from the first nip 32 to the second nip 42. Thus a comparison can be conducted wherein the actual duration between sensing the leading edge 52 and the trailing edge 54 of the leading sheet 22 is measured and compared with the predetermined duration. If the actual duration is substantially equal to the predetermined duration, then the trailing sheet becomes the next leading sheet. The system can then feed the next leading sheet from the first nip 32 to the second nip 42.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

The invention claimed is:

1. A sheet separating apparatus for a sheet feeder comprising:

a first nip and a second nip for feeding a series of sheets therebetween;

said first nip includes a first motor and said second nip includes a second motor for feeding a top sheet from said first nip to said second nip;

a first sensor for sensing a trailing edge of said top sheet and a second sensor for sensing a leading edge of said top sheet wherein said first sensor is upstream of said first motor and said second sensor is downstream of said second motor;

an underlying sheet is prevented from feeding with said top sheet by stopping said first motor when said leading edge of said top sheet is sensed by said second sensor while simultaneously said first sensor remains occluded by said underlying sheet; and, said first sensor and said second sensor have a fixed spacing therebetween wherein said spacing is greater than a sheet length.

2. The apparatus of claim 1, wherein said top sheet has a predetermined length.

3. A sheet separating apparatus for a sheet feeder comprising:

a first nip and a second nip for feeding a series of sheets therebetween;

said first nip includes a first motor and said second nip includes a second motor for feeding a top sheet from said first nip to said second nip;

a first sensor for sensing a trailing edge of said top sheet and a second sensor for sensing a leading edge of said top sheet wherein said first sensor is upstream of said first motor and said second sensor is downstream of said second motor;

an underlying sheet is prevented from feeding with said top sheet by stopping said first motor when said leading edge of said top sheet is sensed by said second sensor while simultaneously said first sensor remains occluded by said underlying sheet;

said first sensor and said second sensor have a fixed spacing therebetween wherein said spacing is greater than a sheet length;

wherein said top sheet has a predetermined length; and, a timer for timing the duration of time between entry of said leading edge and exit of said trailing edge of said top sheet with said second sensor.

4. The apparatus of claim 3, wherein said duration is compared with a predetermined time based upon said predetermined sheet length; and, said underlying sheet becomes a next top sheet and said first motor feeds said underlying sheet from said first nip to said second nip when said duration is substantially equal to said predetermined time.

5. The apparatus of claim 1, wherein said first nip and said second nip have a fixed spacing therebetween.

6. The apparatus of claim 5, wherein a leading edge of said underlying sheet is stopped at a wait point when said first motor is stopped; and, said wait point is positioned between said first nip and said second nip.

7. The apparatus of claim 6, wherein said wait point is upstream from said second motor.

8. The apparatus of claim 1, wherein said underlying sheet has a leading edge; and, said leading edge of said top sheet is offset and downstream from said leading edge of said underlying sheet.

9. A xerographic system, comprising: a sheet feeding apparatus having a first nip and an associated first sensor upstream from a second nip and an associated second sensor;

said first sensor is upstream from said first nip and said second sensor is downstream from said second nip;

said first nip includes a first motor and said second nip includes a second motor for selectively and independently feeding sheets therebetween;

said first nip having a feed motion adapted to feed at least a pair of sheets in a feed direction from said first nip toward said second nip during said feed motion;

said second nip having a feed motion adapted to feed a top sheet from said at least a pair of sheets in said feed direction;

said first nip adapted to halt said feed motion responsive to said first and second sensors wherein an underlying sheet is stopped at a wait point positioned between said first nip and said second nip until said top sheet clears said second sensor;

said first sensor and said second sensor have a fixed first spacing therebetween wherein said first spacing is greater than a sheet length; and, said first nip and said second nip have a fixed second spacing therebetween, wherein said first spacing is greater than said second spacing.

10. The system of claim 9, wherein said pair of sheets each have a predetermined length.

11. The system of claim 10, further including a timer for timing the duration of time between entry of a leading edge and exit of a trailing edge of said top sheet with said second sensor.

12. The system of claim 11, wherein said duration is compared with a predetermined time based upon said predetermined sheet length; and, said underlying sheet becomes a next top sheet and a first motor feeds said underlying sheet from said first nip to said second nip when said duration is substantially equal to said predetermined time.

13. The system of claim 9, wherein a leading edge of said underlying sheet is stopped at said wait point when said first motor is stopped.

14. The system of claim 13, wherein said leading edge of said top sheet is offset and downstream from said leading edge of said underlying sheet.

15. A method of feeding sheets to a printer or a copier, comprising:

applying a feed force in a feed direction to a top sheet;

feeding said top sheet from a first nip to a second nip wherein said first nip includes a first motor and said second nip includes a second motor;

sensing a trailing edge of said top sheet with a first sensor and sensing a leading edge of said top sheet with a second sensor wherein said first sensor is upstream of said first motor and said second sensor is downstream of said second motor;

preventing an underlying sheet from feeding with said top sheet by stopping said first motor while continuing said second motor, when said leading edge of said top sheet is sensed by said second sensor while simultaneously said first sensor remains occluded by said underlying sheet; and, said first sensor and said second sensor have a fixed spacing therebetween wherein said spacing is greater than a sheet length.

16. The method of claim 15, wherein said top sheet has a predetermined length.

17. The method of claim 16, wherein said first nip and said second nip have a fixed spacing therebetween.

18. The method of claim 17, wherein said underlying sheet has a leading edge; and, said leading edge of said top sheet is offset and downstream from said leading edge of said underlying sheet.

19. A method of feeding sheets to a printer or a copier, comprising:

applying a feed force in a feed direction to a top sheet;

feeding said top sheet from a first nip to a second nip wherein said first nip includes a first motor and said second nip includes a second motor;

sensing a trailing edge of said top sheet with a first sensor and sensing a leading edge of said top sheet with a second sensor wherein said first sensor is upstream of said first motor and said second sensor is downstream of said second motor;

preventing an underlying sheet from feeding with said top sheet by stopping said first motor while continuing said second motor, when said leading edge of said top sheet is sensed by said second sensor while simultaneously said first sensor remains occluded by said underlying sheet;

said first sensor and said second sensor have a fixed spacing therebetween wherein said spacing is greater than a sheet length;

wherein said top sheet has a predetermined length;

wherein said first nip and said second nip have a fixed spacing therebetween:

wherein said underlying sheet has a leading edge;

wherein said leading edge of said top sheet is offset and downstream from said leading edge of said underlying sheet;

comparing a time between sensing said leading edge and said trailing edge of said top sheet by said second sensor with a predetermined time, if said time is substantially equal to said predetermined time, then said underlying sheet becomes the next top sheet; and, feeding said next top sheet from said first nip to said second nip.

20. A xerographic system, comprising:

a sheet feeding apparatus having a first nip and an associated first sensor upstream from a second nip and an associated second sensor;

said first sensor is upstream from said first nip and said second sensor is downstream from said second nip;

said first nip includes a first motor and said second nip includes a second motor for selectively and independently feeding sheets therebetween;

said first nip having a feed motion adapted to feed at least a pair of sheets in a feed direction from said first nip toward said second nip during said feed motion;

said second nip having a feed motion adapted to feed a top sheet from said at least a pair of sheets in said feed direction;

said first nip adapted to halt said feed motion responsive to said first and second sensors wherein an underlying sheet is stopped at a wait point positioned between said first nip and said second nip until said top sheet clears said second sensor;

said underlying sheet is prevented from feeding with said top sheet by stopping said first motor, while continuing said second motor, when said leading edge of said top sheet is sensed by said second sensor while simultaneously said first sensor remains occluded by said underlying sheet; and, said first sensor and said second sensor have a fixed first spacing therebetween wherein said first spacing is greater than a sheet length.

21. The system of claim 20, wherein said first nip and said second nip have a fixed second spacing therebetween; and, said first spacing is greater than said second spacing.

* * * * *